United States Patent [19]

Schulze-Beckinghausen

[11] Patent Number: 4,688,453

[45] Date of Patent: Aug. 25, 1987

[54] APPARATUS FOR MAKING AND BRAKING CONNECTIONS BETWEEN SCREW THREADED TUBULAR MEMBERS

[75] Inventor: Joerg E. Schulze-Beckinghausen, Garbsen, Fed. Rep. of Germany

[73] Assignee: Weatherford US Inc., Houston, Tex.

[21] Appl. No.: 817,359

[22] Filed: Jan. 9, 1986

[30] Foreign Application Priority Data

Jan. 9, 1985 [DE] Fed. Rep. of Germany ..... 3500492

[51] Int. Cl.[4] ..... B25B 17/00

[52] U.S. Cl. ..... 81/57.18; 81/57.33

[58] Field of Search ..... 81/57.16, 57.18, 57.2, 81/57.34, 57.15, 57.33; 29/240

[56] References Cited

U.S. PATENT DOCUMENTS

| | | | |
|---|---|---|---|
| 2,618,468 | 11/1952 | Lundeen | 81/57.18 X |
| 3,261,241 | 7/1966 | Catland | 81/57.18 |
| 4,192,206 | 3/1980 | Schulze-Beckinghausen | 81/57.18 |
| 4,297,922 | 11/1982 | Higdon | 81/57.18 |
| 4,437,363 | 3/1984 | Haynes | 81/57.18 |
| 4,494,425 | 1/1985 | Showmake, Sr. | 81/57.2 X |

FOREIGN PATENT DOCUMENTS

| | | |
|---|---|---|
| 2726472 | 12/1978 | Fed. Rep. of Germany . |
| 3234027 | 1/1984 | Fed. Rep. of Germany . |

*Primary Examiner*—Frederick R. Schmidt
*Assistant Examiner*—Steven P. Schad
*Attorney, Agent, or Firm*—Edward D. C. Bartlett

[57] ABSTRACT

An apparatus for making and breaking connections between screw threaded tubular members comprises a jaw carrier. A movable jaw support is pivotally mounted to one end of the jaw carrier while a fixed jaw support is mounted on the other end of the jaw carrier. The fixed jaw support and the jaw carrier each carry a jaw. The centers of the jaws subtend an angle of 90°. The movable jaw support is provided with a jaw which can be advanced towards the other jaws to grip a pipe by the action of a cam on a cam engaging roller mounted on the movable jaw support. The fixed jaw support and the movable jaw support can be interchanged to break and make joints as required.

2 Claims, 5 Drawing Figures

FIG. 2
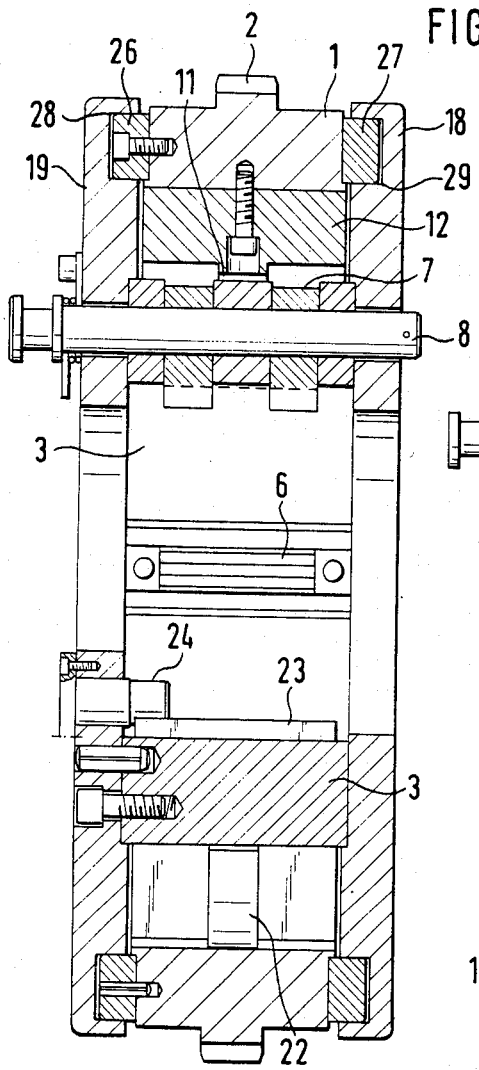
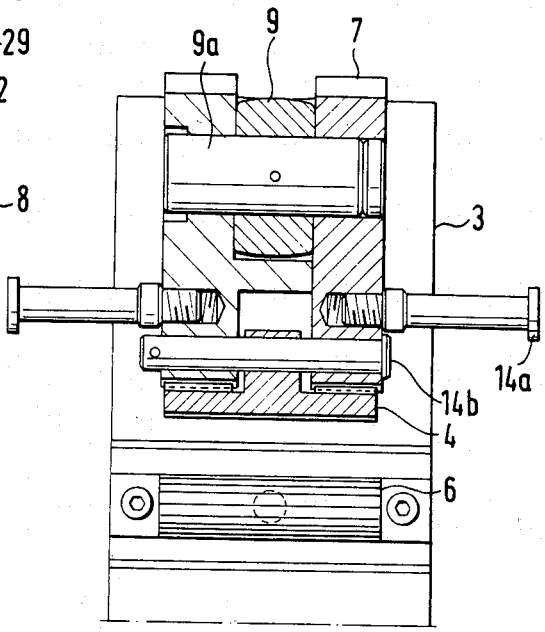
FIG. 5
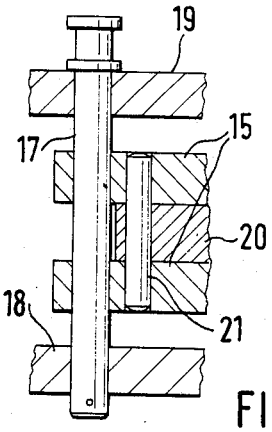
FIG. 3

APPARATUS FOR MAKING AND BRAKING CONNECTIONS BETWEEN SCREW THREADED TUBULAR MEMBERS

FIELD OF THE INVENTION

This invention relates to an apparatus for making and breaking connections between screw threaded tubular members.

BACKGROUND OF THE INVENTION

German Patent specification No. 3 234 027 discloses an apparatus for making and breaking connections between screw threaded tubular members which comprises a rotatable and a non-rotatable chuck disposed along a common axis. The chucks each receive a respective one of two tubular members having male and female screw threaded zones. One chuck is mounted in a bearing block borne rigidly at one end of a frame while the other chuck is disposed on a support block. The apparatus is unwieldy and unsuitable for the performance of the entire screwing process.

German Patent specification No. 2 726 472 discloses the use of pipe tongs having a casing which is formed with a radial cutaway portion adapted to receive a pipe. Disposed in the casing with provision for pivoting by means of a drive system is a toothed rim which is also formed with a matching radial cutaway portion and is provided with cam means having cam surfaces of different pitches. This device is quite suitable for the screw threaded connection of casings which are of substantially uniform diameter. However, drill strings are subject to considerable wear in use. For this reason the pipe diameters in a drill string differ considerably. Furthermore, the breaking of screw threaded connections of drill strings can require very high torques. The open tongues, as disclosed in German Patent specification No. 2 726 472, are not suitable for use with drill strings because of the considerable torques required and the variation in the diameter of the drill string.

It is an object of the invention to provide an apparatus which can be used to make and break screw threaded connections in drill strings and which can be used on a drilling rig.

It is a further object to make such apparatus lightweight so that is can be easily handled.

SUMMARY OF THE INVENTION

The present invention provides an apparatus for making and breaking connections between screw threaded tubular members comprising:

(a) an upper rotor disc having a radially extending cutaway portion to accommodate a screw threaded tubular member;

(b) a lower rotor disc having a radially extending cutaway portion aligned with the radially extending cutaway portion in said upper rotor disc;

(c) a jaw carrier disposed between said upper rotor disc and said lower rotor disc and mounted thereto;

(d) a fixed jaw support mounted on a pin at one end of said jaw carrier;

(e) means to inhibit movement of said fixed jaw support with respect to said pin;

(f) a movable jaw support pivotally mounted on a pin at the other end of said jaw carrier;

(g) a rim having a radial cutaway portion mounted for movement circumjacent said jaw carrier; and (h) cam means on said rim which pivot said movable jaw support inwardly on rotation of said rim relative to said jaw carrier; wherein said fixed jaw support and said movable jaw support are interchangeable to enable said apparatus to both make and break connections between screw threaded tubular members.

For a better understanding of the invention reference will now be made to the following drawings which show one embodiment of an apparatus in accordance with the invention and a modification thereof.

BRIEF DESCRIPTION OF THE DRAWINGS

FIG. 2 is a mirror image of a section taken on line A–B of FIG. 1 with the upper rotor disc in position;

FIG. 3 is a mirror image of a fragmentary section taken on line C–D of FIG. 1;

FIG. 5 is a section taken on line E–F of FIG. 4.

DETAILED DESCRIPTION OF THE PREFERRED EMBODIMENT

Figure 1:
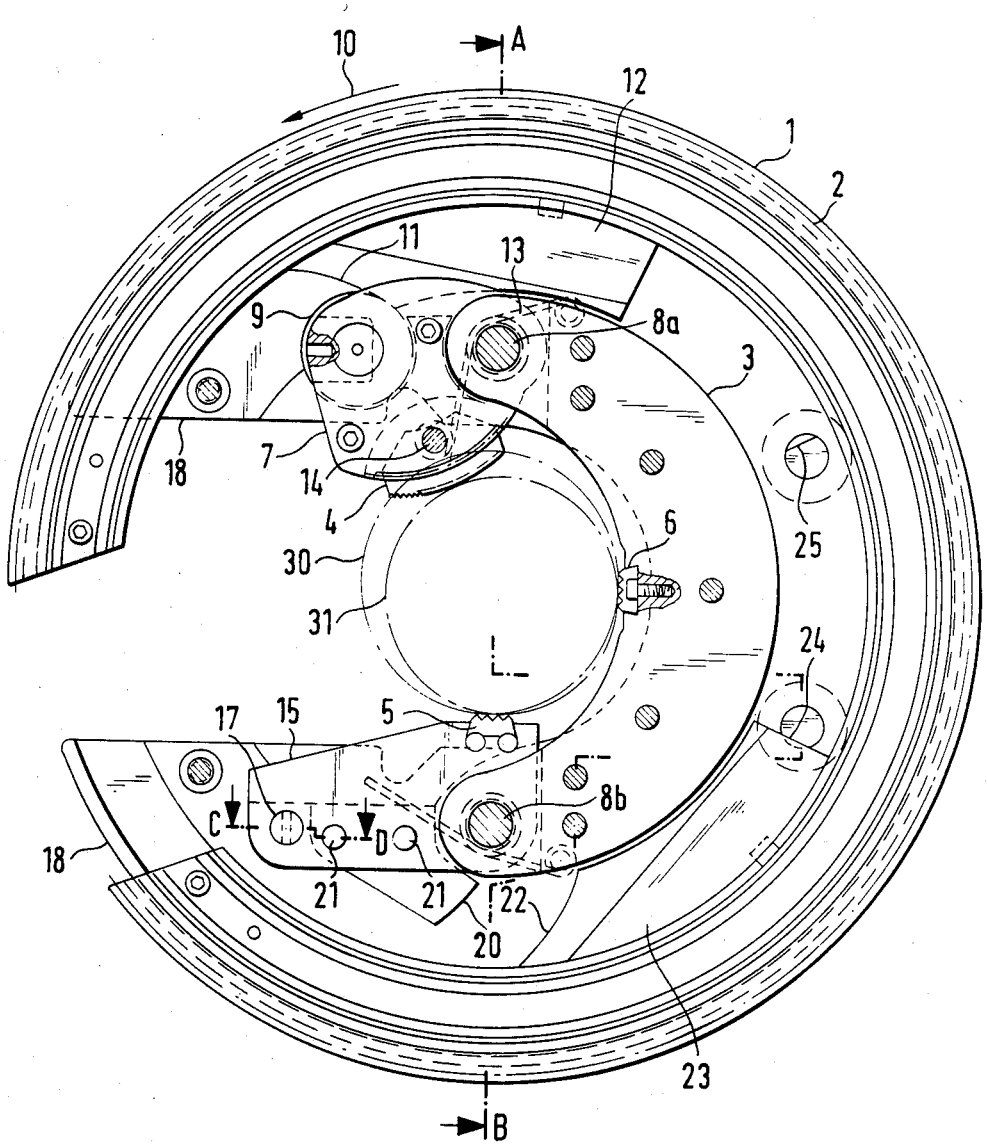
FIG. 1 is a top plan view of one embodiment of an apparatus in accordance with the invention with the upper rotor disc removed.

Referring to FIGS. 1 and 2 of the drawings, there is shown an apparatus for making and breaking a screw-threaded pipe connection.

The apparatus, which is generally identified by reference numeral 1, comprises a jaw carrier 3 to which are bolted an upper rotor disc 19 and a lower rotor disc 18.

A pin 8*a* extends through the upper rotor disc 19, one end of the jaw carrier 3 and the lower rotor disc 18 as shown.

A movable jaw support 7 is pivotally mounted on the pin 8*a* and accommodates a pivot 14 on which is mounted a jaw 4 having a generally convex surface provided with pipe engaging teeth. A cam engaging roller 9 is also rotatably mounted on the movable jaw support 7 as shown.

A pin 8*b* extends through the upper rotor disc 19, the other end of the jaw carrier 3 and the lower rotor disc 18. A fixed jaw support 15 is mounted on the pin 8b and is locked in position by a pin 17 which, as shown in FIG. 3, passes through the upper rotor disc 19, the fixed jaw support 15 and the lower jaw support 18.

A stop 20 is mounted on the fixed jaw support 15 by two pins 21.

A jaw 5 is mounted on the fixed jaw support 15 whilst a jaw 6 is mounted on the jaw carrier 3. The arc between the centre of the jaws 5 and 6 subtends an angle of approximately 90°.

It will be appreciated that a pipe can be gripped between jaws 4, 5 and 6 by applying pressure to roller 9 to displace the movable jaw support 7, and hence jaw 4, towards jaws 5 and 6. To achieve this, the apparatus includes a rim 2, the radial outer extremity of which is provided with drive teeth and the sides of which are provided with rings 26 and 27 which are slidably mounted in annular grooves 28 and 29 in the upper rotor disc 19 and lower rotor disc 18 respectively. Thus, the rim 2 can be rotated relative to the upper rotor disc 19, the lower rotor disc 18 and the jaw carrier 3.

As better seen in FIG. 1, two cam members 12 and 23 are secured fast to the inner periphery of the rim 2. Thus, as the rim 2 is rotated counterclockwise in the direction of arrow 10 in FIG. 1, the roller 9 is displaced inwardly by cam surface 11. Relative movement between the rim 2 and the jaw carrier 3 is limited by the engagement of cam 23 on end stop 24.

Similarly, relative rotation in the clockwise direction is limited by the engagement of the cam surface 22 of cam member 23 with the stop 20.

A spring 13 is wound around pin 8*a* and has two arms, one of which is fixed to the upper rotor disc 19 and the other of which acts on pivot pin 14 and biases the movable jaw support 7 away from the centre of the apparatus.

The rim 2, the upper rotor disc 19 and the lower rotor disc 18 do not subtend 360° but have a portion cutaway to enable a pipe to be introduced into the centre of the apparatus when the cutaway portion in the rim 2 is aligned with the permanently vertically aligned cutaway portions in the upper rotor disc 19 and lower rotor disc 18.

When a rotational force is applied to the rim 2, for example by a motor mounted fast on the lower rotor disc 18, the rim 2 rotates relative to the jaw carrier 3 in the direction of the arrow 10. The cam engaging roller 9 rolls along cam surface 11 of cam member 12 thus causing the jaw 4 to converge on the pipe. Rotation of the rim 2 relative to the jaw carrier 3 is continued until the desired radial gripping force is applied to the pipe.

In FIG. 1, the apparatus is shown in the operative position for breaking joints.

In order to make (tighten) joints the positions of the movable jaw support 7 and the fixed jaw support 15 are reversed. This is achieved by withdrawing pins 8*a*, 8*b* and 17, withdrawing the movable jaw support 7 and the fixed jaw support, turning them over, mounting the movable jaw support 7 on pivot pin 8*b*, mounting the fixed jaw support 15 on pin 8*a* and locking it in position by inserting pin 17 through a hole (not shown) in the upper rotor disc 19, the fixed jaw support 15 and a hole (not shown) in the lower rotor disc 18. In this position movement of the rim 2 clockwise with respect to the jaw carrier 3 is limited by end stop 25 engaging cam member 12 and movement anticlockwise by the engagement of cam surface 11 with the stop 20.

Returning now to FIG. 1, due to the convex shape of jaw 4, its pivotal mounting on pivot pin 14 and the ability of movable jaw support 7 to pivot about pin 8*a*, pipes of differing sizes can be gripped in a satisfactory manner. Circle 31 represents a $5\frac{7}{8}''$ diameter pipe whilst circle 30 represents a $6\frac{1}{2}''$ diameter pipe.

In the example, $5\frac{7}{8}''$ is the smallest diameter pipe which the apparatus can handle. If an attempt is made to grip a pipe of smaller diameter the cam engaging roller 9 simply rolls up the cam surface 11 and along the radially innermost surface of cam member 12 until the cam member 23 engages the end stop 24.

The relative position of the cam engaging roller 9 the jaw 4 and the pivot 8*a* ensures that pipes of difference diameter can be properly gripped. In particular, with pipes of smaller diameter the lever arm between the pivot pin 8*a* and the cam engaging roller 9 becomes smaller. However, the effective lever arm for multiplying the clamping force is increased. That point on the drill string at which the forces act lies between the centre of gravity of the jaw and the central point of the whole system. As a result, after the jaw 4 has seized the drill pipe an inwardly directed force is set up which ensures reliable gripping by the jaw. The angle of pitch of 30°–60°, preferably 45°, of the cam surfaces 11, 22 produces a substantially tangentially directed loading of the rim 2, and therefore inhibits its ends from being opended up in the zone of the cutaway portion.

Due to its small mass, the apparatus described with reference to the drawings can be manually guided while at the same time is capable of exerting the maximum torques required for locking and breaking the screw threaded connections of drill strings. The ratio between the maximum torques and the weight of the device is substantially greater than in the prior art constructions. The three-point clamping, more particularly in conjunction with the arrangement of the rigid jaws at an angle of 90° to one another, results in optimum clamping with the minimum loss of time.

It will be noted that once the jaws have gripped the pipe the apparatus can be used for unscrewing the entire joint, i.e. for "spinning". This is a considerable advantage over the apparatus shown in German Patent Specification No. 3 234 027.

Figure 4:
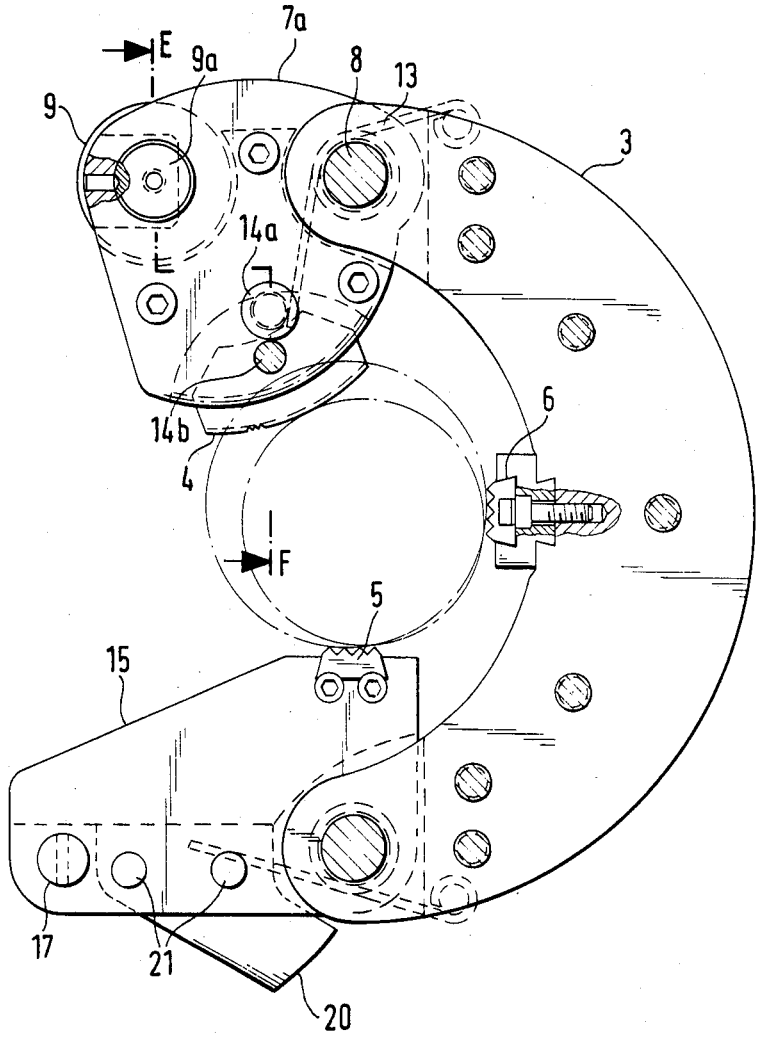
FIG. 4 is a plan view, to an enlarged scale, showing a jaw carrier, movable jaw support and fixed jaw support similar to those incorporated in the apparatus shown in FIG. 1 but with minor modifications.

The arrangement shown in FIGS. 4 and 5 differs from that shown in FIGS. 1 to 3 in that the spring 13 does not act against the pin 14 but against a separate and distinct pin 14*a*.

Various modifications to the apparatus described are envisaged, for example the jaw carrier 3 could be disposed with. In such an embodiment the jaw 6, fixed jaw support 15 and movable jaw support 7 would be connected to the upper rotor disc 19 and the lower rotor disc 18.

What is claimed is:

1. An apparatus for making and breaking connections between screw threaded tubular members of differing diameters, comprising:

(a) spaced-apart upper and lower annular rotor discs having radially extending cutaway portions, circumferentially aligned, to accommodate receipt of screw threaded tubular members of differing diameters;

(b) each of said upper and lower rotor discs having annular grooves in the periphery of rotor disc surfaces facing each other;

(c) first and second rings mounted in said annular grooves for circumferential sliding movement;

(d) an annular rim having a radial cutaway portion, means securing the periphery of said rim to said first and second rings for annular rotation of said rim within said spaced-apart rotor discs about a central axis of the apparatus whereby said radial cutaway portion of said rim may be aligned with said radially extending cutaway portions of said upper and lower rotor discs to receive screw threaded tubular members of differing diameters into central, open portions of said annular rotor discs and rim;

(e) first and second cam means on said rim;

(f) an arcuate-shaped jaw carrier fixedly mounted between said upper and lower rotor discs for non-rotation relative to said rotor discs, said arcuate carrier subtending an angle in the order of 180°;

(g) a fixed jaw mounted on said arcuate-shaped jaw carrier at approximately a mid-portion of said arcuate carrier;

(h) a fixed jaw support, a jaw mounted on said fixed jaw support, pin means removably mounting said fixed jaw support on said arcuate-shaped jaw carrier near one end of said arcuate carrier;

(i) removable pin means inhibiting movement of said fixed jaw support about said removably mounting pin means;

(j) a movable jaw support, a jaw having a convex gripping surface, first pin pivotally mounting said convex jaw on said movable jaw support, second pin means removably mounting said movable jaw support on said arcuate-shaped jaw carrier near an opposite end of said arcuate carrier in the order of 180° opposite said fixed jaw support;

(k) a can engaging roller mounted on said movable jaw support, said roller having a cam engaging surface, said cam engaging surface of said cam engaging roller being spaced-apart from said second pin means removably mounting said movable jaw support by a distance greater than the distance between the center of mass of said jaw support and said pin means, whereby upon annular rotational movement of said rim circumjacent said arcuate-shaped jaw carrier and said movable jaw support about the central axis of the apparatus, one of said first and second cam means on said rim engages said cam engaging roller and pivots said movable jaw support and said convex jaw into gripping engagement with a screw threaded tubular member with a gripping force which increases as said pivoted convex jaw pivots into progressively more forceful engagement with the round surface of the tubular member, gripped between said two fixed jaws and said movable convex jaw, and substantially increased torque is applied to the tubular member regardless of its diameter as said rim continues to move circumjacent said movable jaw carrier and said forcefully gripped tubular member.

2. The apparatus as claimed in Claim 1, wherein each of said first and second cam means on said rim include cam surfaces which are inclined between 30 and 60 degrees from a line passing through the central axis of said apparatus and the leading edge of the respective cam means.

* * * * *